US007164337B1

(12) United States Patent
Furia

(10) Patent No.: US 7,164,337 B1
(45) Date of Patent: Jan. 16, 2007

(54) SPLASH PROOF ELECTROMAGNETIC DOOR HOLDER

(75) Inventor: Andrea Furia, Downey, CA (US)

(73) Assignee: RSG/Aames Security, Inc., Long Beach, CA (US)

( * ) Notice: Subject to any disclaimer, the term of this patent is extended or adjusted under 35 U.S.C. 154(b) by 29 days.

(21) Appl. No.: 11/013,037

(22) Filed: Dec. 11, 2004

(51) Int. Cl.
*H01F 7/20* (2006.01)

(52) U.S. Cl. ..... 335/285; 335/280

(58) Field of Classification Search ..... 335/285–289; 292/251.5

See application file for complete search history.

(56) References Cited

U.S. PATENT DOCUMENTS

| | | | | |
|---|---|---|---|---|
| 3,204,154 | A * | 8/1965 | Crandell | 335/289 |
| 3,261,631 | A * | 7/1966 | Alessi | 292/251.5 |
| 4,669,766 | A * | 6/1987 | Hanchett et al. | 292/251.5 |
| 4,696,500 | A * | 9/1987 | Zunkel | 292/251.5 |
| 4,852,919 | A | 8/1989 | Nimee et al. | 292/251.5 |
| 5,139,293 | A | 8/1992 | Zimmerman et al. | 292/251.5 |
| 5,566,376 | A | 10/1996 | Dye et al. | 361/206 |
| 5,610,794 | A * | 3/1997 | Dye et al. | 361/206 |
| 5,709,421 | A | 1/1998 | Gillham | 292/251.5 |
| 5,741,034 | A | 4/1998 | Bains et al. | 292/338 |
| 6,049,287 | A * | 4/2000 | Yulkowski | 340/693.12 |
| 6,392,519 | B1 * | 5/2002 | Ronning | 336/90 |
| 6,737,947 | B1 * | 5/2004 | Volckmann et al. | 336/90 |
| 6,753,471 | B1 * | 6/2004 | Johnson et al. | 174/50 |

* cited by examiner

*Primary Examiner*—Elvin Enad
*Assistant Examiner*—Bernard Rojas
(74) *Attorney, Agent, or Firm*—Kenneth L. Green; Edgar W. Averill, Jr.

(57) ABSTRACT

A splash proof electromagnetic door holder is sealed to prevent failures caused by exposure to moisture. The electromagnetic door holder comprises a ground box, a main housing attached to the ground box, and a coil assembly attached to the main housing. The coil assembly includes a bobbin containing a wire coil. A sealant, preferably epoxy, covers the face of the bobbin to prevent moisture from entering the coil assembly. A seal is incorporated between a coil passage in the main housing and the coil assembly. Seals are included between the main housing and the ground box. The resulting the electromagnetic door holder resists the entry of moisture into the electromagnetic door holder and thereby improves the reliability of the electromagnetic door holder.

16 Claims, 7 Drawing Sheets

SPLASH PROOF ELECTROMAGNETIC DOOR HOLDER

BACKGROUND OF THE INVENTION

The present invention relates to splash proof electrical devices and in particular to splash proof electromagnetic door holders.

Electromagnetic door holders are commonly used in commercial buildings to release doors when, for example, fire alarms go off. A common type of electromagnetic door holder is a floor mounted electromagnetic door holder. A catch plate is mounted to the door, and swivelled to align the catch plate with the electromagnetic door holder. The electromagnetic door holder is attached to the floor to contact the catch plate when the door is fully open. The electromagnetic door holder is energized to hold the catch plate, and thereby hold the door in the open position. When electricity to the electromagnetic door holder is removed, the catch plate is released, and the door may close.

Unfortunately, such electromagnetic door holders generally reside in areas subjected to moisture. For example, water may be splashed on the electromagnetic door holder when the floor is mopped, and if the electromagnetic door holder is near an exit, rain water, or irrigation water, may reach the electromagnetic door holder. An electrical failure of the electromagnetic door holder may result from such exposure to moisture.

BRIEF SUMMARY OF THE INVENTION

The present invention addresses the above and other needs by providing a splash proof electromagnetic door holder which is sealed to prevent failures caused by exposure to moisture. The electromagnetic door holder comprises a ground box, a main housing attached to the ground box, and a coil assembly attached to the main housing. The coil assembly includes a bobbin containing a wire coil. A sealant, preferably epoxy, covers the face of the bobbin to prevent moisture from entering the coil assembly. A seal is incorporated between a coil passage in the main housing and the coil assembly. Seals are included between the main housing and the ground box. The resulting the electromagnetic door holder resists the entry of moisture into the electromagnetic door holder and thereby improves the reliability of the electromagnetic door holder.

In accordance with one aspect of the invention, there is provided a moisture resistant electromagnetic door holder comprising a ground box, a main housing attached to the ground box, and a sealed coil assembly attached to the main housing and having an exposed face. The main housing includes a coil passage and the coil assembly resides in the coil passage. A coil O-Ring resides between the main housing and the coil assembly to prevent moisture from entering the electromagnetic door holder through the coil passage.

In accordance with another aspect of the invention, there is provided a moisture resistant electromagnetic door holder comprising a ground box, a main housing attached to the ground box, and a sealed coil assembly attached to the main housing and having an exposed face. The coil assembly comprises a bobbin and a coil housing, and the bobbin resides in the coil housing. A sealing material resides over an otherwise exposed surface of the bobbin to prevent moisture from entering the coil assembly through the bobbin.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
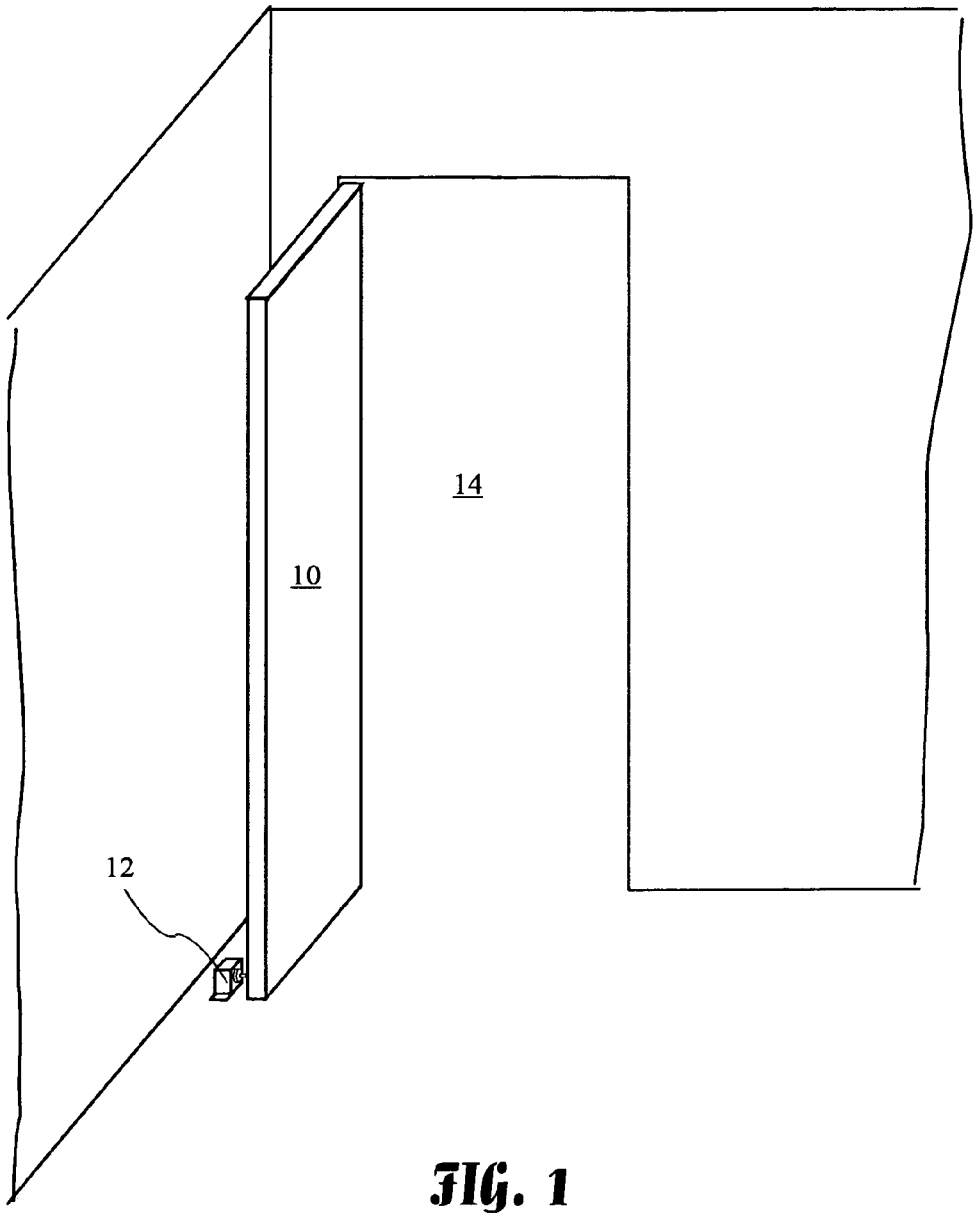
FIG. 1 shows a door held open by an electromagnetic door holder.

A door 10 held open by an electromagnetic door holder 12 is shown in FIG. 1. The electromagnetic door holder 12 holds the door 10 open as long as power is provided to the electromagnetic door holder 12. In the case of fire, or some other triggering event, power is removed, and the electromagnetic door holder 12 releases the door 10 to close in the doorway 14. As can be seen, the electromagnetic door holder 12 resides on the floor and is thus exposed to floor cleaning liquids, and if the electromagnetic door holder 12 is near an exit, rain water, or irrigation water, may reach the electromagnetic door holder 12.

Figure 2B:
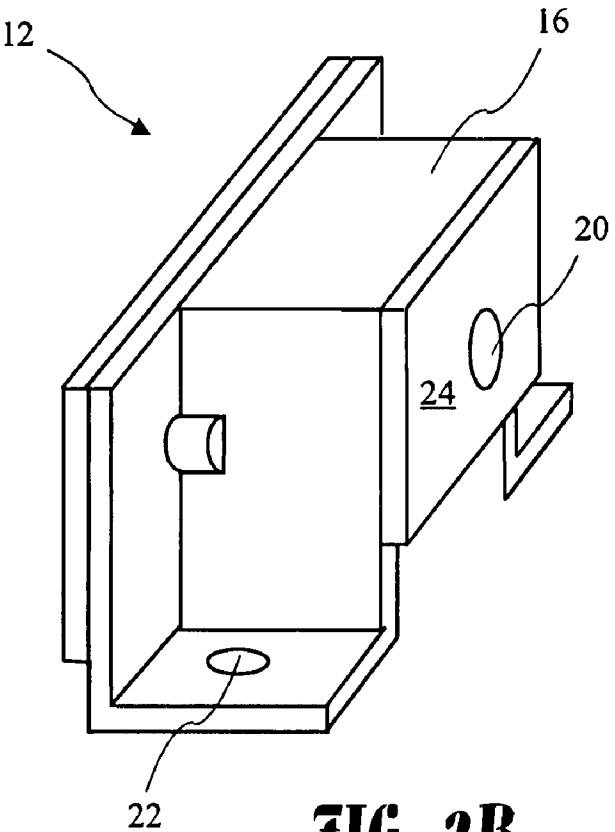
FIG. 2B shows a rear perspective view of the splash proof electromagnetic door holder.
Figure 2A:
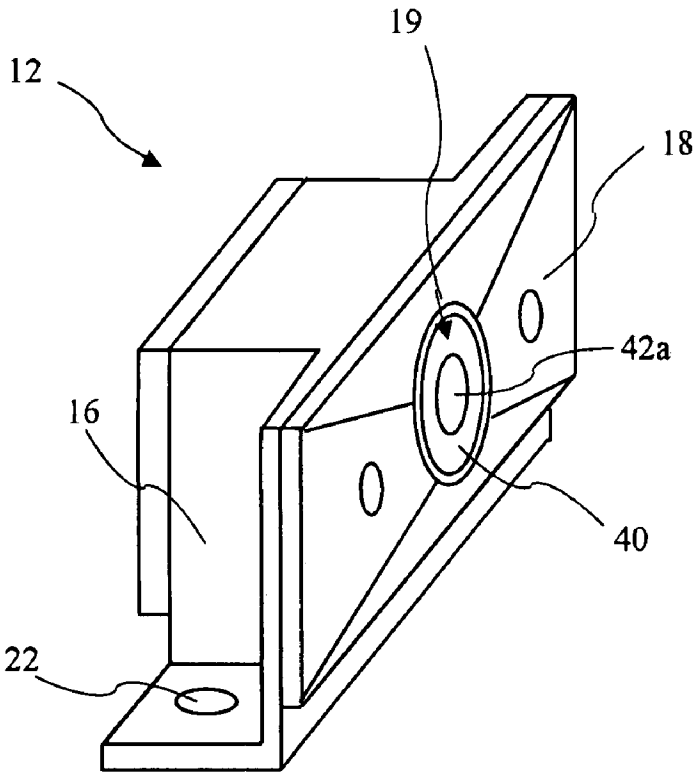
FIG. 2A shows a front perspective view of a splash proof electromagnetic door holder according to the present invention.

A front perspective view of a splash proof electromagnetic door holder 12 according to the present invention is shown in FIG. 2A, and a rear perspective view of the splash proof electromagnetic door holder 12 is shown in FIG. 2B. The door holder 12 comprises a ground box 16, ground box mounting holes 22, a main housing 18 supporting coil assembly 26 (see FIGS. 3A, 3B, 4) having a coil face 19, and a ground box cover 24 with a plug 20. The plug 20 may be removed to allow an electrical conduit to be attached to the ground box 16, which electrical conduit is preferably a moisture proof electrical conduit.

Figure 3B:
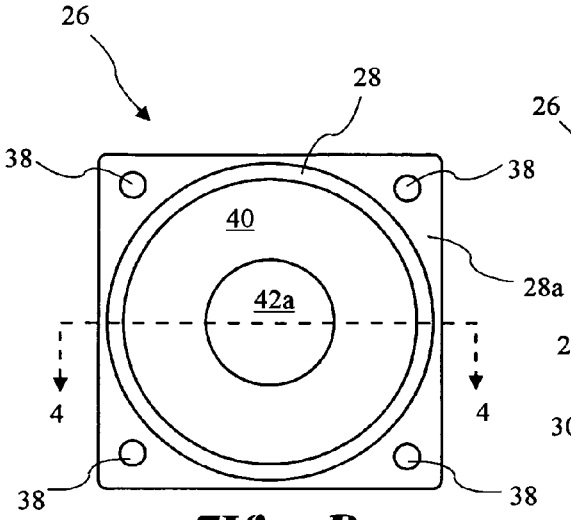
FIG. 3B is a top view of the sealed coil assembly.
Figure 3A:
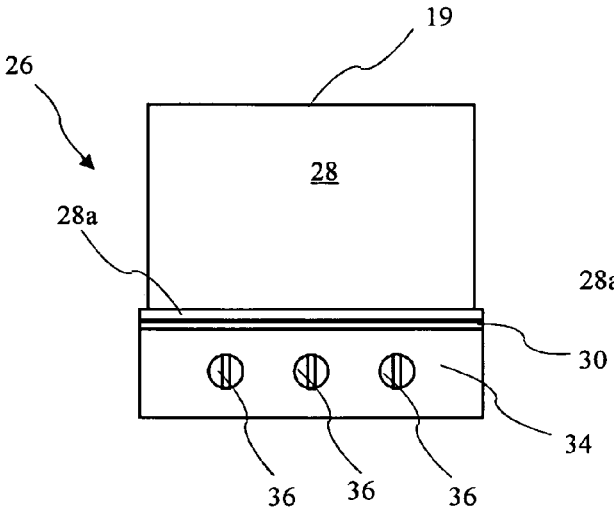
FIG. 3A is a side view of the sealed coil assembly.
Figure 3:
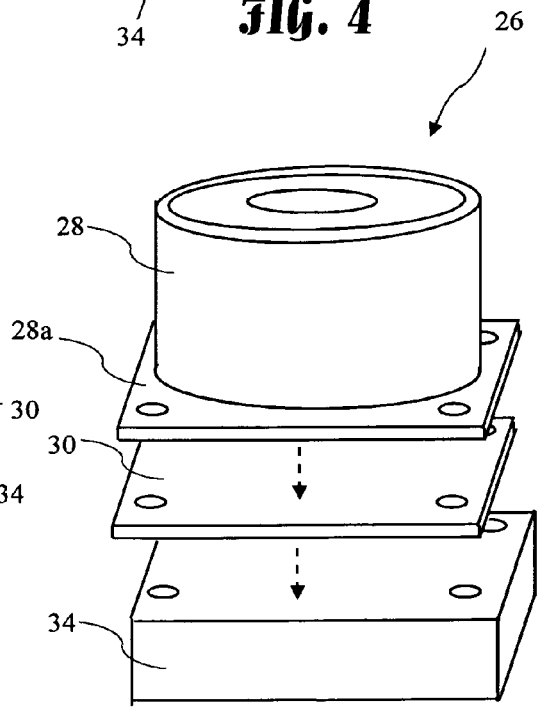
FIG. 3 is a perspective view of a sealed coil assembly according to the present invention.

A perspective view of a sealed coil assembly 26 according to the present invention is shown in FIG. 3. The coil assemble 26 comprises a circuit housing 34, a coil insulator 30, and a coil housing 28, having a base portion (or flange) 28*a*.

A side view of the coil assembly 26 according to the present invention is shown in FIG. 3A and a top view of the coil assembly 26 is shown in FIG. 3B. The coil assembly 26 includes three electrical terminals 36 for connecting a power source to the coil assembly 26. The coil assembly preferably receives a power signal between 12 and 24 Volts Direct Current (VDC) or between 24 and 120 Volts Alternating Current (VAC) to energize the coil. Four coil screw passages 38 are provided in the base portion 28*a* for attaching the coil assembly 26 to the main housing 18 (FIG. 2A). A coil insulator 30 resides between the coil housing 28 and a circuit housing 34. The three electrical terminals 36 preferably reside on the exterior of the circuit housing 34.

Figure 4:
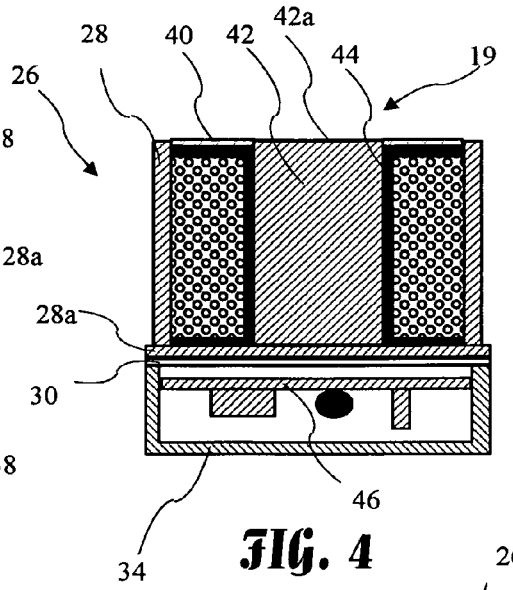
FIG. 4 is a cross-sectional view of the coil assembly taken along line 4—4 of FIG. 3B.

A cross-sectional view of the coil assembly taken along line 4—4 of FIG. 3B is shown in FIG. 4. The coil face 19 comprises a coil seal 40 residing over a bobbin 44, and a core face 42*a* of a core 42. The seal 40 resists the entry of moisture into the coil assembly 26, and preferably prevents the entry of moisture into the coil assembly 26. The seal 40 is preferably an epoxy seal. A Printed Circuit (PC) board 46 resides in the circuit housing 34.

Figure 5A:
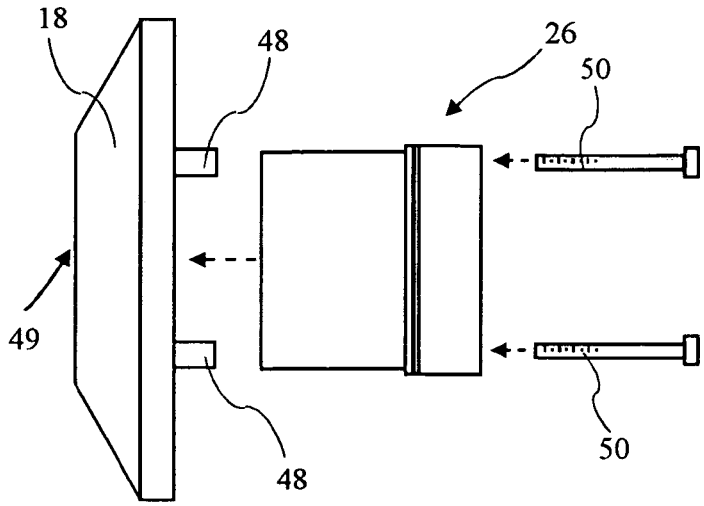
FIG. 5A shows a main housing and the coil assembly prior to assembly.

The main housing 18 and the coil assembly 26 are shown prior to assembly in FIG. 5A. The main housing 18 includes coil posts 48 for attachment of the coil assembly 26 to the main housing 18 using coil screws 50.

Figure 5B:
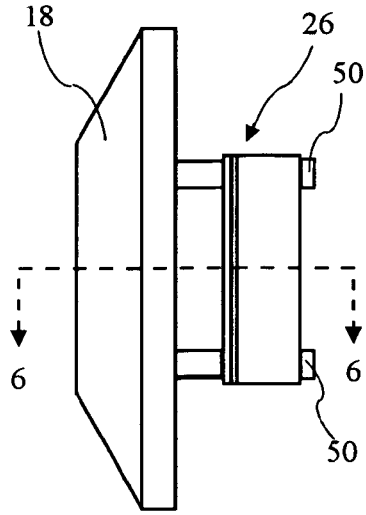
FIG. 5B shows the main housing and the coil assembly after assembly.
Figure 6:
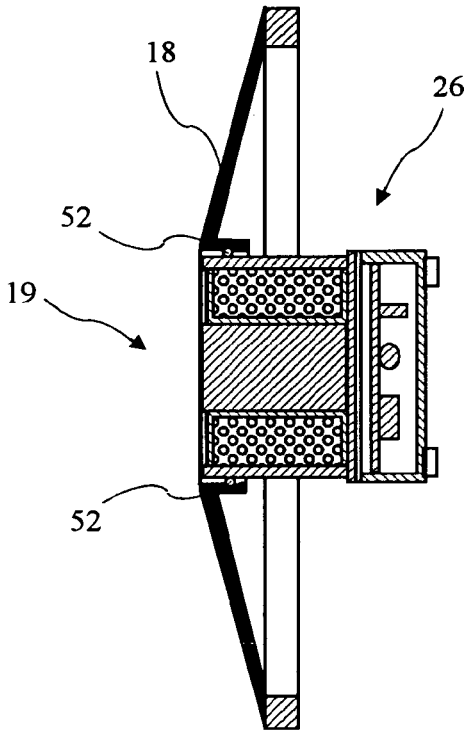
FIG. 6 is a cross-sectional view of the assembled main housing and coil assembly taken along line 6—6 of FIG. 5B.

The main housing 18 and the coil assembly 26 are shown after assembly in FIG. 5B. A cross-sectional view of the assembled main housing 18 and the coil assembly 26 taken along line 6—6 of FIG. 5B is shown in FIG. 6. The coil assembly 26 resides in a coil passage 49 (see FIG. 7). A moisture seal comprising an coil O-Ring 52 resides between the coil assembly 26 and the coil passage 49, thereby resisting the entry of moisture into the door holder 12, and preferably preventing the entry of moisture into the door holder 12.

Figure 6B:
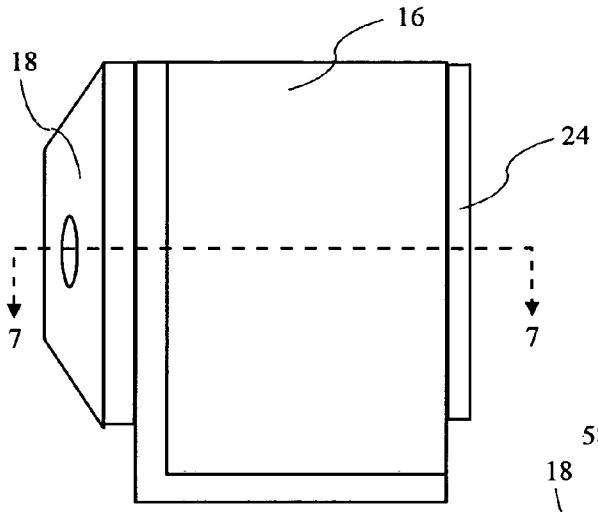
FIG. 6B is an end view of the main housing attached to the ground box.
Figure 7:
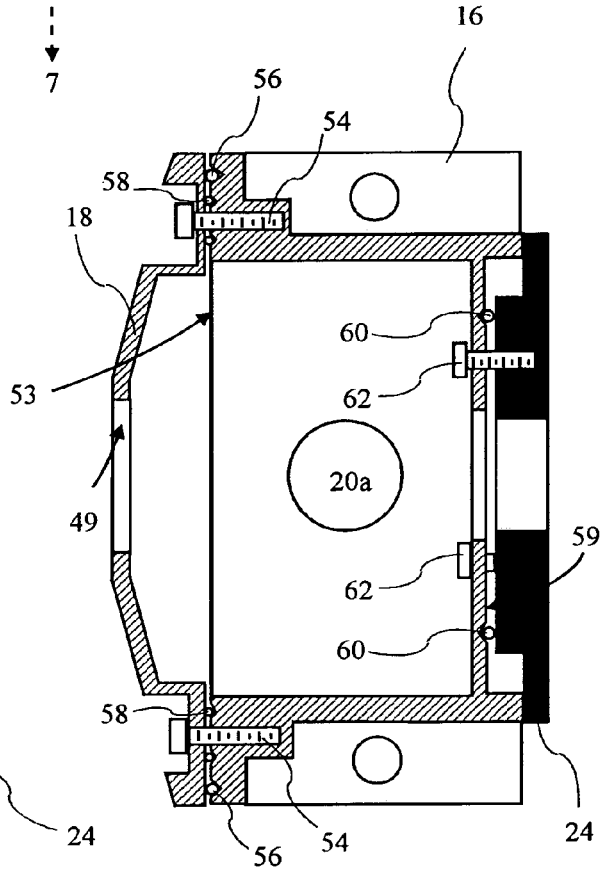
FIG. 7 is a cross-sectional view of the main housing attached to the ground box taken along line 7—7 of FIG. 6B.
Figure 6A:
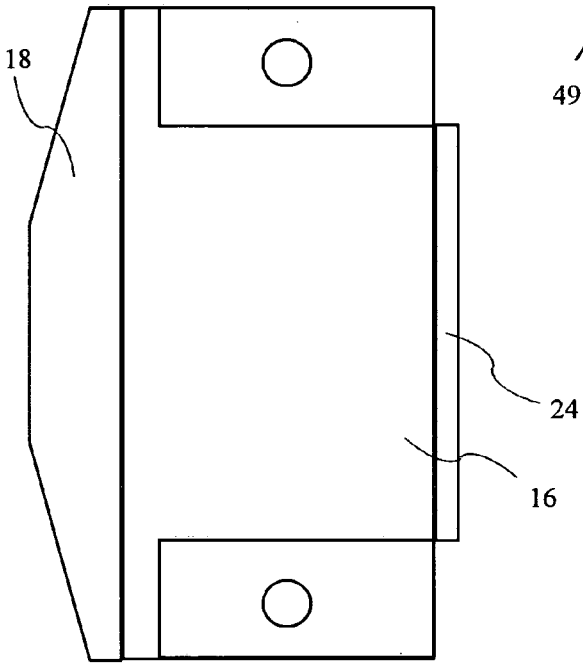
FIG. 6A is a top view of the main housing attached to a ground box.

A top view of the main housing 18 attached to a ground box 16 is shown in FIG. 6A, and an end view of the main housing 18 attached to the ground box 16 is shown in FIG. 6B. A cross-sectional view showing the main housing 18 attached to a housing mating surface 53 of the ground box 16, taken along line 7–7 of FIG. 6B, is shown in FIG. 7. The main housing 18 is attached to the ground box 16 by main housing screws 54, and the ground box cover 24 is attached to the ground box 16 by cover screws 62. A second plug 20*a* resides in a bottom surface of the ground box, which plug 20*a* may be removed to allow electrical conduit to be attached to the ground box 16.

A moisture proof housing seal is provided between the main housing 18 to the housing mating surface 53 to resisting the entry of moisture into the door holder 12, and preferably preventing the entry of moisture into the door holder 12. The moisture proof housing seal comprises a main housing O-Ring 56 running proximal to an outer edge of the main housing 18 and housing screw O-Rings 58 residing around the main housing screws 54.

A cover moisture seal resides between the ground box cover 24 and the ground box 16 to resisting the entry of moisture into the door holder 12, and preferably preventing the entry of moisture into the door holder 12. The cover moisture seal comprises a cover O-Ring 60 residing between a cover mating surface 59 of the ground box 16 and the ground box cover 24.

Figure 8A:
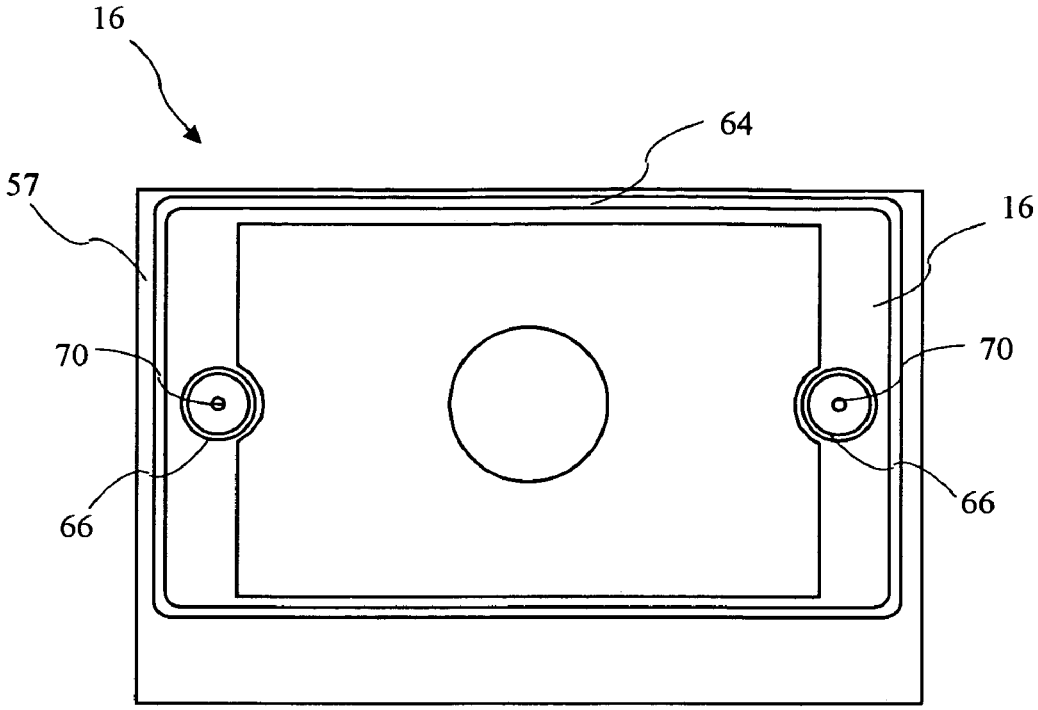
FIG. 8A is a front view of the ground box showing a housing mating surface of the ground box.

A front view of the ground box 16 showing the housing mating surface 53 (see FIG. 7) of the ground box 16 is shown in FIG. 8A. A main housing O-Ring groove 64 in the housing mating surface 53 is provided to position the main housing O-Ring 56, wherein the main housing O-Ring 56 partially resides in the main housing O-Ring groove 64. Housing screw O-Ring grooves 66 in the housing mating surface 53 are provided to position the housing screw O-Rings 58, wherein the housing screw O-Rings 58 partially reside in the housing screw O-Ring grooves 66.

Figure 8B:
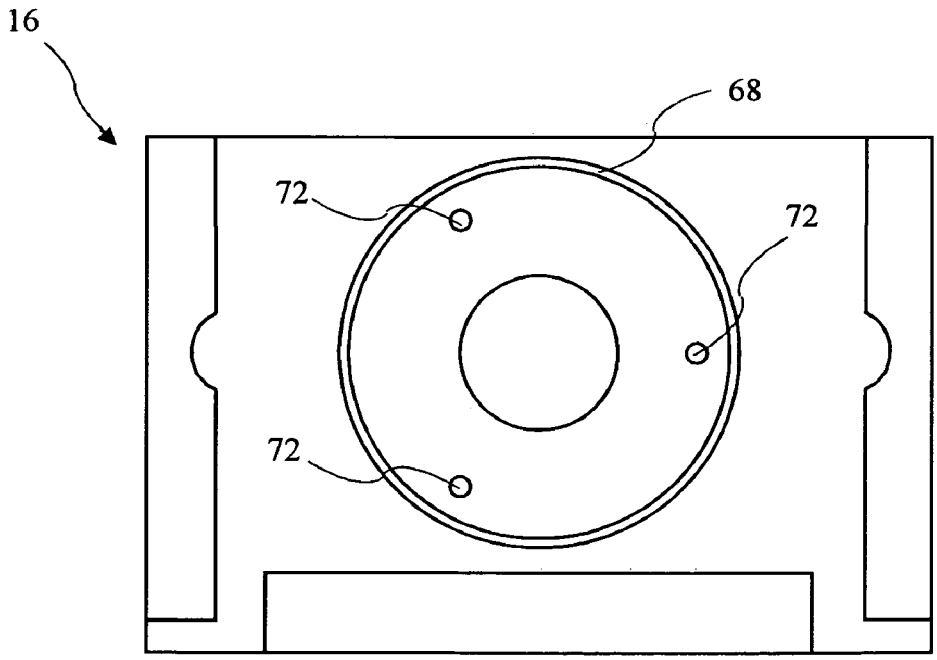
FIG. 8B is a rear view of the ground box showing a cover mating surface of the ground box.

A rear view of the ground box 16 showing the cover mating surface 59 (see FIG. 7) of the ground box 16 is shown in FIG. 8B. Cover screw passages 72 are provided for the cover screws 62 (see FIG. 7). A cover O-Ring groove 68 in the cover mating surface 59 is provided to position the cover O-Ring 60, wherein the cover O-Ring 60 partially resides in the main cover O-Ring groove 68.

Figure 9A:
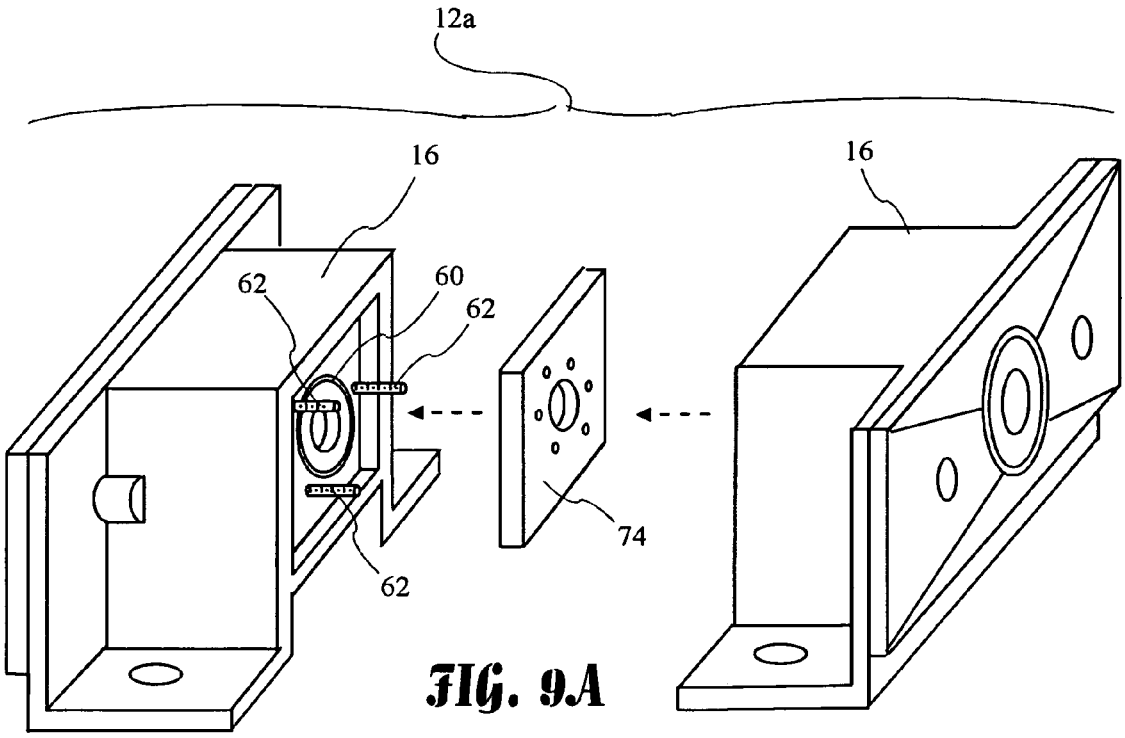
FIG. 9A shown an unassembled double door holder according to the present invention.
Figure 9B:
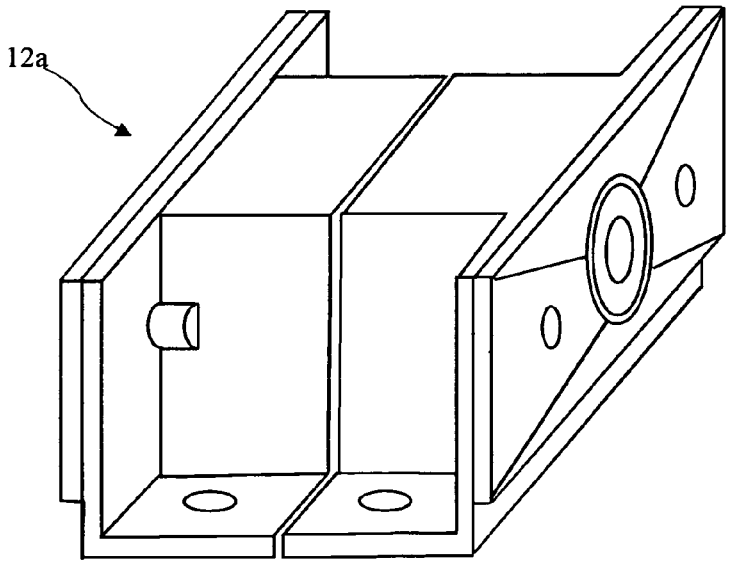
FIG. 9B shown an assembled double door holder according to the present invention.

A double door holder 12*a* is shown unassembled FIG. 9A and assembled in FIG. 9B. A link plate 74 resides between the ground boxes 16. The cover screws 62 attach each ground box 16 to the link plate 74, and the cover O-Rings 60 provide seals between each ground box 16 and the link plate 74.

While the invention herein disclosed has been described by means of specific embodiments and applications thereof, numerous modifications and variations could be made thereto by those skilled in the art without departing from the scope of the invention set forth in the claims.

I claim:

1. A splash proof electromagnetic door holder comprising:

a main housing;

a sealed coil assembly including a coil bobbin residing around a core and a seal residing over the bobbin at a coil face of the coil assembly, the coil assembly attached to the main housing; and a ground box including mounting holes and a housing mounting surface for attachment of the main housing, wherein the coil face of the coil assembly resides on an exterior of the door holder and the seal resists the entry of moisture into the door holder, and wherein the main housing is sealed to the ground box by a moisture proof housing seal and the main housing is attached to the ground box by main housing screws, and wherein the moisture proof housing seal further includes housing screw seals between the main housing and the ground box, and around the main housing screws.

2. The splash proof electromagnetic door holder of claim 1, wherein the main housing includes a coil passage and the coil assembly resides in the coil passage, and a moisture proof coil seal resides between the main housing and the coil assembly.

3. The splash proof electromagnetic door holder of claim 2, wherein the coil seal is a coil O-Ring residing between the coil assembly and the main housing.

4. The splash proof electromagnetic door holder of claim 2, wherein the coil passage includes a coil O-Ring groove and the coil O-Ring partially resides in the coil O-Ring groove.

5. The splash proof electromagnetic door holder of claim 1, wherein the moisture proof housing seal includes a main housing O-Ring running proximal to an outer edge of the main housing.

6. The splash proof electromagnetic door holder of claim 5, wherein the housing mounting surface includes a main housing O-Ring groove, wherein the main housing O-Ring partially resides in the main housing O-Ring groove.

7. The splash proof electromagnetic door holder of claim 1, wherein the housing screw seals are housing screw O-Rings.

8. The splash proof electromagnetic door holder of claim 7, wherein the main housing resides on a housing mating surface of the ground box, and the housing mating surface includes housing screw O-Ring grooves, wherein the housing screw O-Rings partially reside in the housing screw O-Ring grooves.

9. The splash proof electromagnetic door holder of claim 1, further including a ground box cover residing on a surface of the ground box opposite the main housing, and wherein a cover moisture seal resides between the ground box cover and the ground box.

10. The splash proof electromagnetic door holder of claim 9, wherein the cover moisture seal is a cover O-Ring.

11. The splash proof electromagnetic door holder of claim 9, wherein:

the ground box cover resides over a cover mounting surface of the ground box;

the cover mounting surface includes a cover O-Ring groove; and the cover O-Ring partially resides in the cover O-Ring groove.

12. The splash proof electromagnetic door holder of claim 1, further includes a link plate adapted to reside on a surface of the ground box opposite the main housing, wherein two splash proof electromagnetic door holders may be mated back-to-back using the link plate, wherein cover O-Rings reside between the link plate and each splash proof electromagnetic door holder.

13. A moisture resistant electromagnetic door holder comprising:

a main housing;

a sealed coil assembly including a coil bobbin residing around a core and a seal residing over the bobbin at a coil face of the coil assembly, the coil assembly attached to the main housing; and a ground box including mounting holes and a housing mounting surface for attachment of the main housing, wherein the coil face of the coil assembly resides on an exterior of the door holder and the seal resists the entry of moisture into the door holder, and wherein the main housing is sealed to the ground box by a moisture proof housing seal and the main housing is attached to the around box by main housing screws, and wherein the moisture proof housing seal further includes housing screw seals between the main housing and the ground box, and around the main housing screws, and wherein the main housing includes a coil passage and the coil assembly resides in the coil passage, and a coil O-Ring resides between the main housing and the coil assembly.

14. The splash proof electromagnetic door holder of claim 13, wherein the coil assembly comprises a bobbin and a coil housing, and wherein the bobbin resides in the coil housing, and wherein a sealing material resides over an otherwise exposed surface of the bobbin.

15. The splash proof electromagnetic door holder of claim 13, wherein the main housing includes a coil passage and the coil assembly resides in the coil passage, and a coil O-Ring resides between the main housing and the coil assembly.

16. A moisture resistant electromagnetic door holder comprising:

a main housing;

a sealed coil assembly including a coil bobbin residing around a core and a seal residing over the bobbin at a coil face of the coil assembly, the coil assembly attached to the main housing;

a ground box including mounting holes and a housing mounting surface for attachment of the main housing, and a link plate adapted to reside on a surface of the ground box opposite the main housing, wherein two splash proof electromagnetic door holders may be mated back-to-back using the link plate, wherein cover O-Rings reside between the link plate and each splash proof electromagnetic door holder wherein the coil face of the coil assembly resides on an exterior of the door holder and the seal resists the entry of moisture into the door holder.

* * * * *